US006443505B1

(12) United States Patent
Linares et al.

(10) Patent No.: US 6,443,505 B1
(45) Date of Patent: Sep. 3, 2002

(54) VARIABLE TURN LATCH ASSEMBLY AND METHOD

(75) Inventors: Rodolfo A. Linares; George N. Alvarado, both of Whittier, CA (US)

(73) Assignee: S.P.E.P. Acquisitions, Inc., Carson, CA (US)

( * ) Notice: Subject to any disclaimer, the term of this patent is extended or adjusted under 35 U.S.C. 154(b) by 0 days.

(21) Appl. No.: 09/510,575

(22) Filed: Feb. 22, 2000

(51) Int. Cl.[7] ..... E05C 3/06
(52) U.S. Cl. ..... 292/195; 292/1
(58) Field of Search ..... 292/1, 194–196, 292/200, 347, 336.3, DIG. 30, DIG. 37, DIG. 53, DIG. 64; 70/379 R, 380, 367–369, 224

(56) References Cited

U.S. PATENT DOCUMENTS

| | | | | |
|---|---|---|---|---|
| 2,733,089 A | | 1/1956 | Grevengoed | |
| 3,110,512 A | | 11/1963 | Scalf | |
| 3,374,649 A | | 3/1968 | Weidman | |
| 3,500,668 A | | 3/1970 | Henry | |
| 3,549,184 A | * | 12/1970 | Anderson | 292/195 |
| 3,885,269 A | | 5/1975 | Helland | |
| 4,563,885 A | | 1/1986 | Madden | |
| 4,616,864 A | | 10/1986 | Douglas | |
| D287,458 S | | 12/1986 | Decursu | |
| 4,630,457 A | * | 12/1986 | Kincaid et al. | 70/369 |
| 5,123,683 A | | 6/1992 | Solovieff | |
| 5,265,453 A | * | 11/1993 | Konii et al. | 70/379 R |
| 5,265,924 A | | 11/1993 | Kim | |
| 5,390,517 A | * | 2/1995 | Yamada | 70/224 X |
| D360,345 S | | 7/1995 | Swan et al. | |
| 5,509,703 A | | 4/1996 | Lau et al. | |
| 5,634,359 A | * | 6/1997 | Huebschen | 70/379 R |
| 5,664,448 A | * | 9/1997 | Swan et al. | 70/224 |
| 5,732,580 A | * | 3/1998 | Garnault et al. | 70/379 R |
| 5,907,963 A | * | 6/1999 | Myers et al. | 70/379 R |

FOREIGN PATENT DOCUMENTS

| | | | |
|---|---|---|---|
| DE | 9104325 | 8/1992 | |
| EP | 0175211 | 3/1986 | |
| EP | 446566 | 9/1991 | |
| EP | 491133 | 6/1992 | |
| FR | 1493446 | 7/1967 | |
| GB | 2 049 017 A | * 12/1980 | 292/336.3 |

* cited by examiner

*Primary Examiner*—J. J. Swann
*Assistant Examiner*—Ruth C. Rodriguez
(74) *Attorney, Agent, or Firm*—Cislo & Thomas LLP

(57) ABSTRACT

A latch assembly that comprises a housing, a plug or actuator, and an engagement arm wherein the actuator is rotatably held within the housing and the engagement arm is mounted to the actuator, and wherein the actuator and engagement arm may be assembled in several orientations relative to the housing. Each different assemblage provides for a different range and direction of operation. As a result, the latch of the present invention can operate as a quarter-turn latch or a half-turn-latch. As a quarter-turn latch, the latch may be operated in any one of the four 90° quadrants around the axis of rotation, and it may operate in either the clockwise or counter-clockwise direction. As a half-turn latch, the latch may likewise be operated in either one of the two 180° halves of a full circle around the axis of rotation, and it may operate in either the clockwise or counter-clockwise direction. Further, in one configuration assemblage, the engagement arm will operate as a bi-directional quarter-turn latch, rotatable throughout a quarter-turn in either the clockwise or counter-clockwise direction.

14 Claims, 7 Drawing Sheets

VARIABLE TURN LATCH ASSEMBLY AND METHOD

BACKGROUND OF THE INVENTION

This invention relates to turn latch assemblies and, in particular, to turn latch assemblies that may be multiply configured by an operator to suit the requirements of a particular closure.

A typical latch involves two principal positions: a first position in which the latch is engaged with an external catch, wall, or other barrier; and a second position in which the latch is disengaged from the external catch. The typical latch is configured to operate between these two positions and may not easily be disassembled and reassembled to obtain a different pair of first and second positions. Thus, the typical latch dictates what the first and second positions are, and, consequently, is of use only in connection with those closure arrangements designed to require precisely those first and second positions. As a result, the typical latch is useful in only a single closure arrangement.

Some latches have addressed this limitation by being relatively easily disassembled and reassembled in a limited number of predetermined latch configurations. Accordingly, such a latch provides the operator with a limited number of options so that the latch may be used in more than one closure arrangement. Such a latch may be thereby conformed to the requirements of a limited number of tasks.

As an example of this, U.S. Pat, No. 5,509,703 discloses a quarter-turn latch that may be disassembled and reassembled by the operator in any one of four possible configurations such that the engagement arm of the latch can operate in any one of the four 90° quadrants around a central axis of rotation. That is, the latch may be assembled to have one of four possible combinations of first and second positions. Thus, according to the disclosure, the engagement arm may operate in the range of either 0° to 90°, 90° to 180°, 180° to 270°, or 270° to 360° (i.e., 0°).

One problem with the above-mentioned latch, however, is that while it appears to offer four options, the latter two options are redundant with the former two options. That is, the latter two options may be achieved simply by rotating the entire latch housing itself 180°. Thus, the configuration of the latch disclosed in that patent provides for the latter two options is unnecessary and redundant. Many rotatable latches that do not otherwise provide for alternative configurations have housings that may be mounted in either a first or a second orientation such that the second orientation is rotated 180° from the first orientation.

Another problem with the above-mentioned latch and latches assemblies having such combination of mechanisms is that they provide configuration options for only clockwise operation. Yet another problem with the above-mentioned latch is that it is strictly a quarter-turn latch; it does not provide an option where it may be operated throughout a 180° range (i.e., a half-turn latch option).

BRIEF SUMMARY OF THE INVENTION

The present invention relates to a latch assembly, and in particular, a latch assembly that may be assembled in any one of a number of configurations such that the range of operation of the latch can be made to conform to the particular needs of many different closures. The preferred embodiment of the present invention relates in particular to a rotation latch assembly that may be assembled as either a quarter-turn latch or a half-turn latch, and as either a clockwise latch or a counter-clockwise latch.

The preferred embodiment of the present invention involves a latch assembly comprising a housing, a plug insert or actuator, and an engagement arm. The actuator or insert plug is rotatably held at least in part within the housing and is configured such that it may rotate between a first and a second position. The engagement arm is fixed to the insert plug at one end and thus rotates in concert with the actuator.

The range of rotation of the actuator is bound at least by first and second surfaces of a first protrusion formed in or fixed to the inner surface of the housing. The range of the engagement arm is bound at least by first and second surfaces of a second protrusion formed on or fixed to the outer surface of the housing. The range of the actuator and the engagement arm together is thus bound by the more restrictive of the protrusions as they interact with the actuator or engagement arm, and this range varies according to the orientation in which the engagement arm is mounted to the actuator.

The combination of these two different limits on the range of rotation of the actuator and engagement arm provides a surprising diversity of latch configurations and thus a surprising number of alternative ranges of operation according to the present invention. The latch of the present invention, therefore, can operate as a quarter-turn latch or a half-turn-latch. As a quarter-turn latch, the latch may be assembled such that the engagement arm may be operated in any one of the four 90° quadrants around the axis of rotation, and it may operate in either the clockwise or counter-clockwise direction. That is, it may be assembled such that the engagement arm will rotate clockwise to engage an external catch, or it may be assembled such that the engagement arm will rotate counter-clockwise to engage the external catch.

As a half-turn latch, the latch may likewise be assembled such that the engagement arm may be operated in either one of the two 180° halves of a full circle around the axis of rotation, and it may operate in either the clockwise or counter-clockwise direction. Further, the latch may be configured alternatively as a bi-directional quarter-turn latch. That is, in one configuration assemblage, the engagement arm will operate throughout a quarter-turn in either the clockwise or counter-clockwise direction.

DETAILED DESCRIPTION OF THE PREFERRED EMBODIMENTS

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
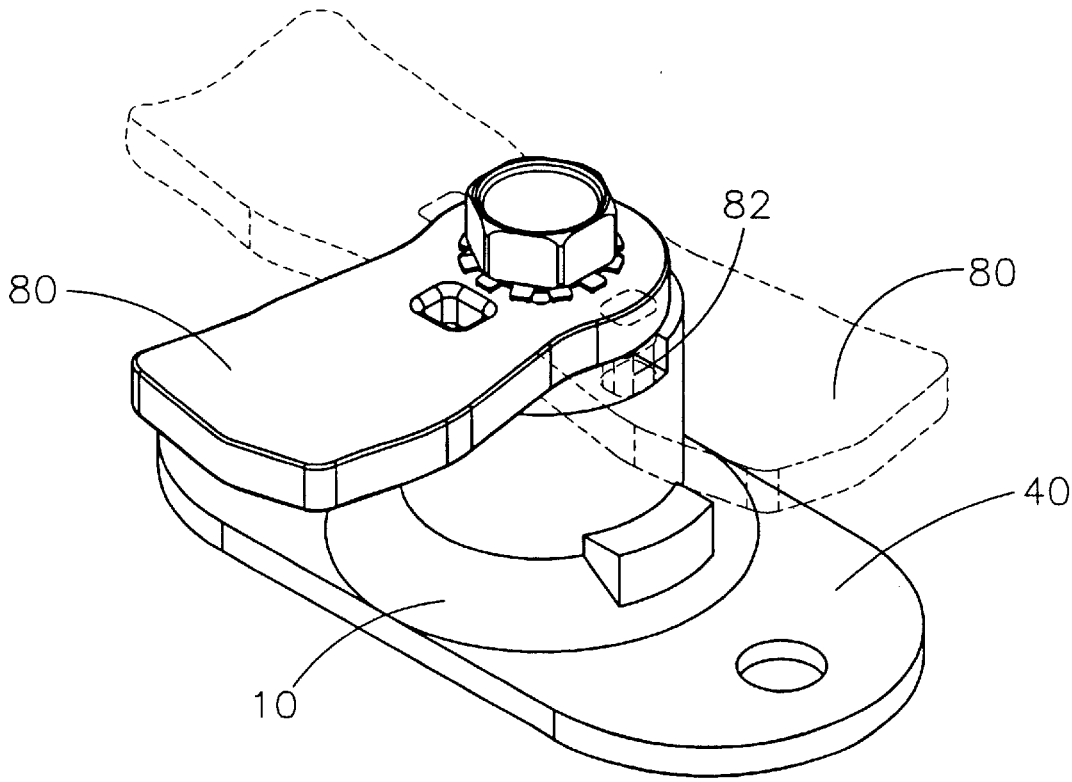
FIG. 1 is a perspective view of one embodiment of the present invention showing alternative positions of the engagement arm in broken lines.
Figure 2:
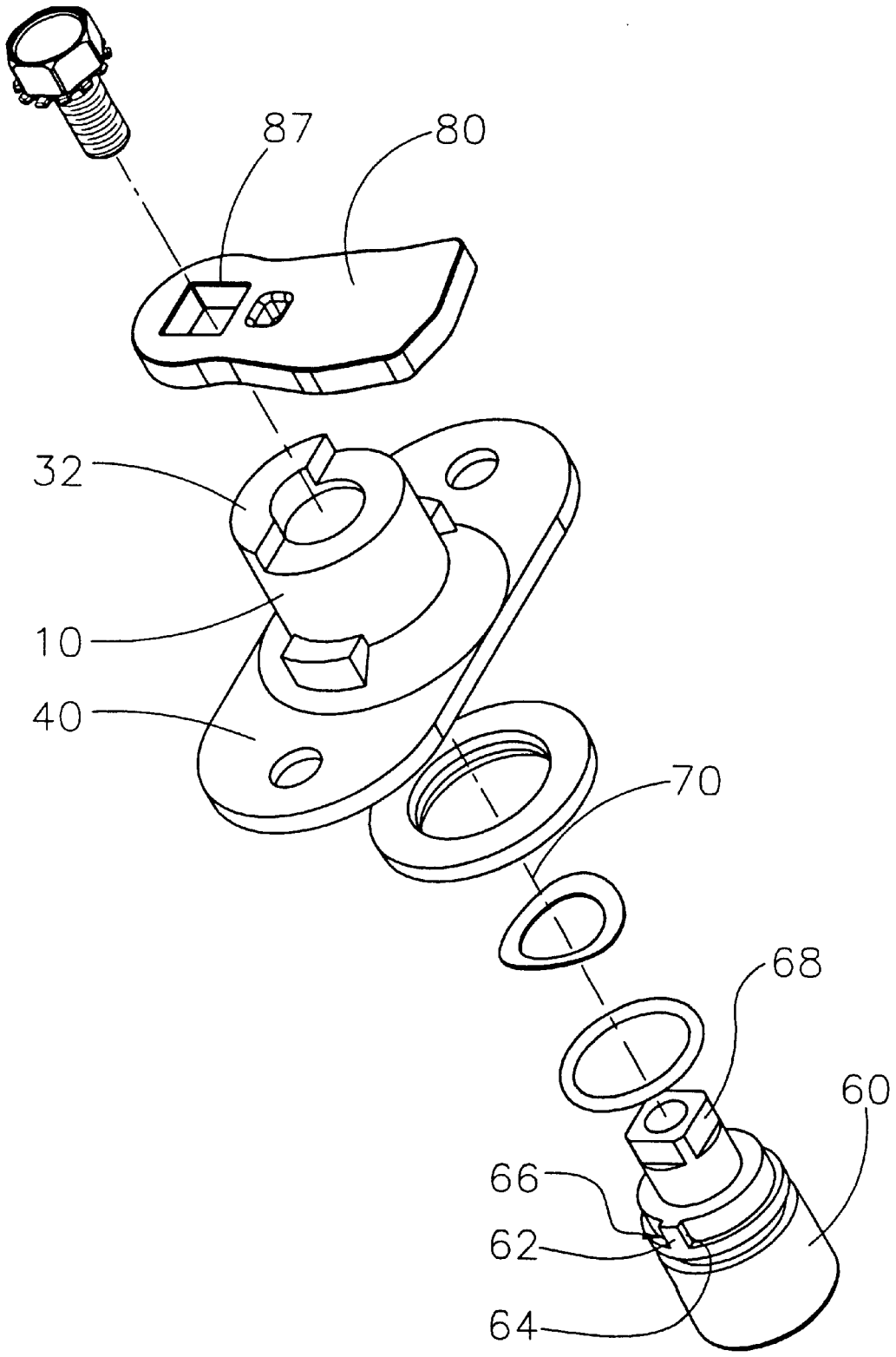
FIG. 2 is an exploded perspective view of one embodiment of the present invention.

The preferred embodiment of the present invention is shown in FIGS. 1 and 2 and involves a latch assembly comprising a housing 10, an insert plug or actuator 60, and an engagement arm 80. The housing 10 has an inner surface 20 and an outer surface 30. The inner surface 20 is for the most part approximately cylindrical and sized to rotatably receive at least a portion of the insert plug 60. Affixed to or formed on a portion of the inner surface 20 of the housing is a first housing protrusion 22 for limiting the range of rotation of the insert plug or actuator 60.

The outer surface 30 of the housing has an upper portion, a body portion, and a lower portion. The lower portion of the outer surface forms a radially outwardly extending flange 40 to facilitate the attachment and mounting of the housing 10 to the surface of a door, wall, or other closure structure, such as via bolt holes 42. The body portion of the outer surface 30 is approximately cylindrical and is intermediate the lower and upper portions. The upper portion of the outer surface contains an upper surface which forms a radially inwardly extending flange. The upper surface further has a protrusion affixed thereto or formed thereon, called hereinafter the second housing protrusion 32. FIGS. 1 through 6 show the first and second housing protrusions formed of as a raised integral part of the housing from the same material as the housing itself, but the first and/or second housing protrusions could just as well be a pin, dowel, or bracket. The pin, dowel, or bracket could be friction pressed into a receiving depression in the housing or could be otherwise fused or soldered onto the inner or outer surface of the housing 10.

The actuator 60 is rotatably held at least in part within the housing and has an actuator protrusion. The housing 10 and actuator 60 thereby are configured such that the actuator may rotate between a first and a second position. The range of rotation of the actuator is bound at least by the first and second surfaces 24 and 26, respectively, of the first housing protrusion 22. This range may be further limited as discussed below, but the first order of limitation on the range of rotation of the actuator is defined by the first and second surfaces of the first housing protrusion. As the actuator 60 is rotated to either said first or second position, the actuator protrusion 62 encounters either the first or second surface, respectively, of the first housing protrusion 22.

Figure 3:
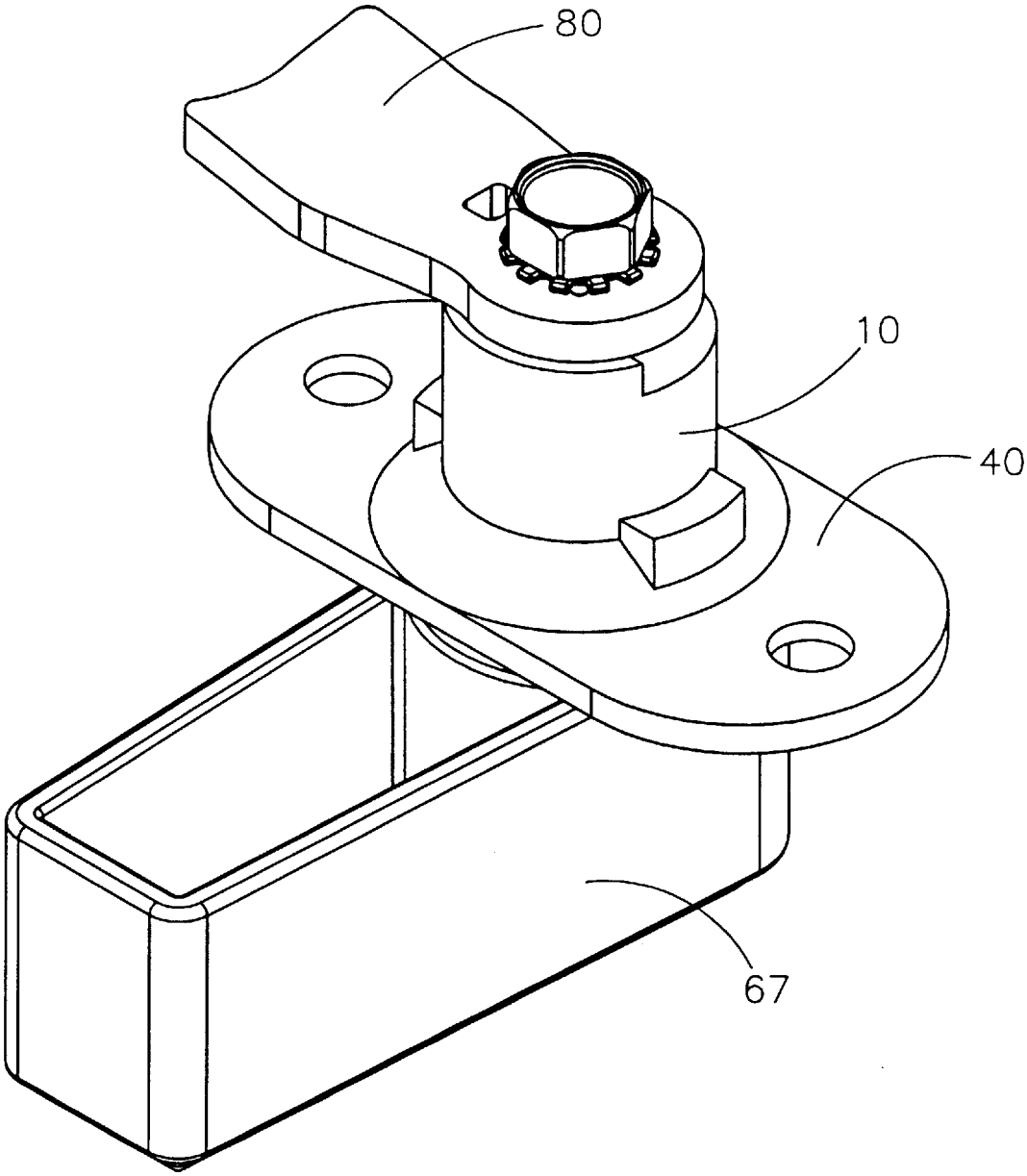
FIG. 3 is a perspective view of one embodiment of the present invention showing a handle as part of the operating portion of the insert plug.
Figure 4:
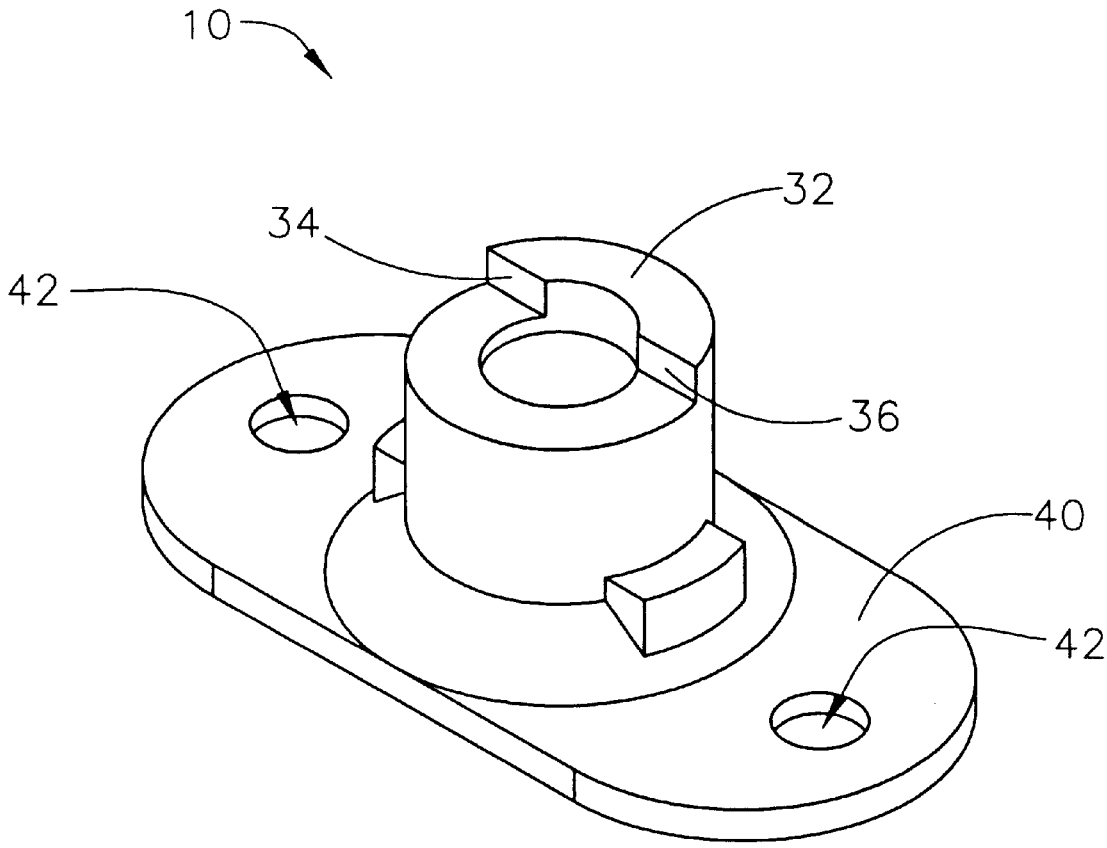
FIG. 4 is a perspective view of the latch housing of one embodiment of the present invention.

The insert plug or actuator 60 further has an operating portion 67 and an actuating portion 68. The operating portion 67 may be any means for applying an external angular force on the insert plug in order to cause it to rotate between the said first and second positions. The preferred embodiments of the present invention include as the operating portion 67, a handle as shown in FIG. 3, or simply a surface having a depression for receiving a screwdriver or other such torque imparting tool for exerting an angular force on the insert plug, as shown in FIG. 1.

Figure 7:
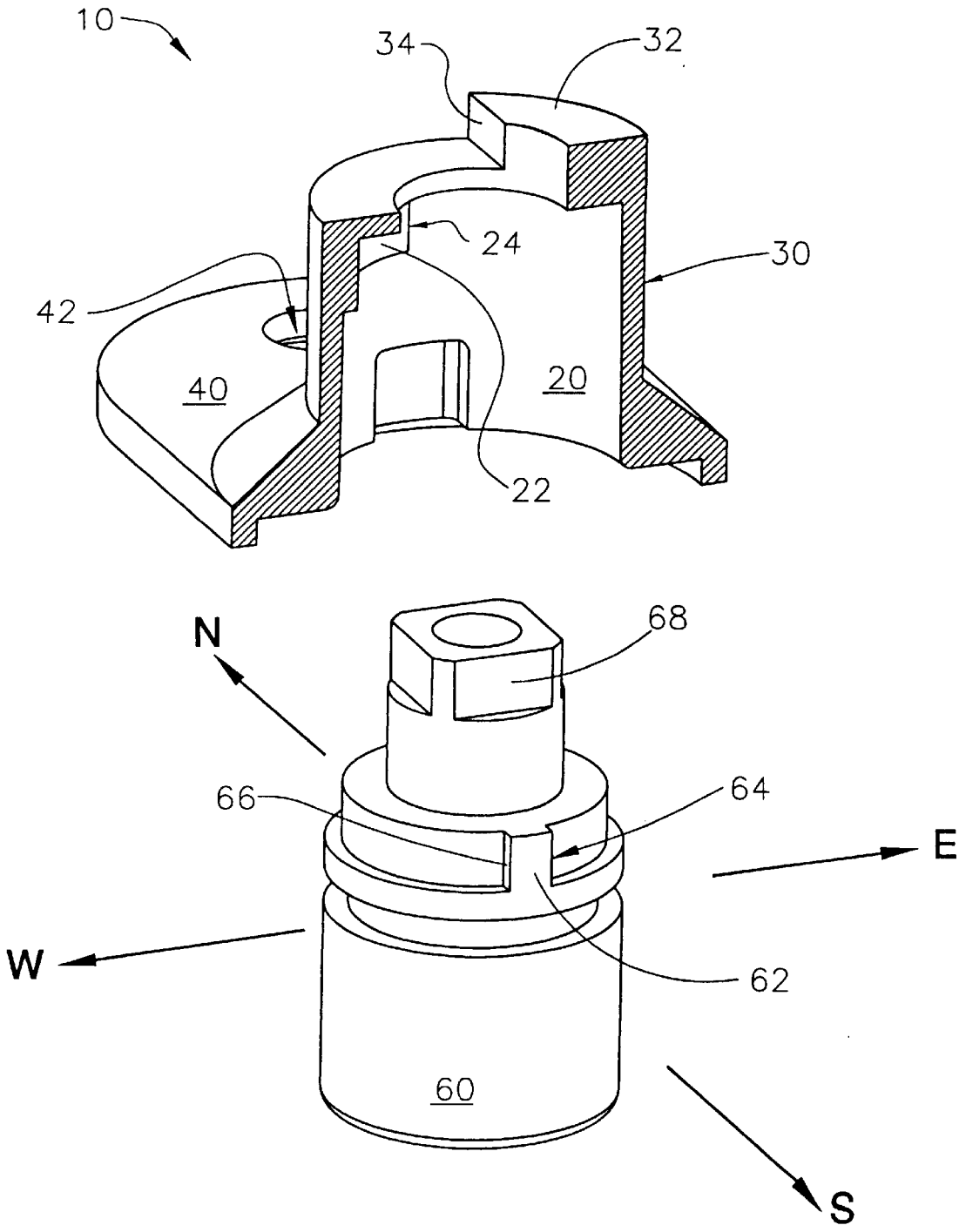
FIG. 7 is a perspective and sectional view of the latch housing of FIG. 6 and a perspective view of the actuator of one embodiment of the present invention showing the actuator protrusion in one orientation, namely facing towards the S (south) designation.

The actuating portion 68 of the actuator is configured to receive the engagement arm. FIGS. 2 and 7 show an approximately square configuration for the actuating portion 68, but any number of other configurations may be used to attach to a mating attachment portion 87 of the engagement arm. This invention contemplates other configurations for the actuating portion 68 which would equally fall within the present invention, including without limitation, an actuating portion 68 that defines an orifice for receiving the attachment portion 87 of the engagement arm, or the like.

The engagement arm 80 is mounted to the actuator 60 and thus rotates in concert with the actuator. The engagement arm 80 comprises an attachment portion 87, an engagement portions 89, an arm portion 88 intermediate the attachment and engagement portions 89, and an engagement arm protrusion 82. The attachment portion 87 is configured to mate with the actuator portion of the actuator or insert plug. The engagement portion 89 of the engagement arm is designed to engage with a catch or other structure mounted to the wall, door or closure to be latched, and the arm portion 88 of the engagement arm provides the extension necessary for the engagement arm to reach the catch.

The engagement arm protrusion 82 is configured and oriented to encounter the first or second surface 34 or 36, respectively, of the second housing protrusion 32 when the engagement arm approaches the first or second positions, respectively, that defined ends of the range of rotation of the engagement arm. The engagement arm protrusion 82 illustrated in FIG. 2 is in the form of an indentation formed in pressed sheet metal or the like, but it may just as easily be a rivet, a cross pin, or a bend or elbow formed in part or throughout the width of the engagement arm. Any such method for defining a stopping means for the engagement arm 80 could be employed without deviating for the scope and spirit of the present invention.

The second housing protrusion 32 thus limits the range of rotation of the engagement arm by interfering with the angular motion of the engagement arm protrusion 82. At the same time, the first housing protrusion 22 limits the range of rotation of the actuator by interfering with either the first surface 64 or the second surface 66 of the actuator protrusion 62. The combination of the of the respective range limitations caused by the first and second housing protrusions may result in a variety of ranges of rotation for the entire latch assembly. For example, if the actuator is positioned in the latch housing such that the actuator protrusion 62 is adjacent to a first surface 24 of the first housing protrusion 22 and the engagement arm is attached to the actuator portion of the actuator in the orientation such that the engagement arm protrusion 82 is adjacent to the second surface 36 of the second housing protrusion 32, the latch assembly is capable of rotating a full range before rotation is stopped by either the second surface of the first housing protrusion 22 or the second surface of the second housing protrusion 32. For instance, the preferred embodiment illustrated in FIGS. 4 through 7 is capable of a full range of 180°.

If, on the other hand, the engagement arm is attached to the actuator and oriented such that the engagement arm is intermediate between the first and second surfaces 34 and 36, respectively, of the second housing protrusion, then the latch assembly is capable of rotating only half of the range described above. The preferred embodiment illustrated in FIGS. 4 through 7 is capable of a full range of 90°.

Figure 5:
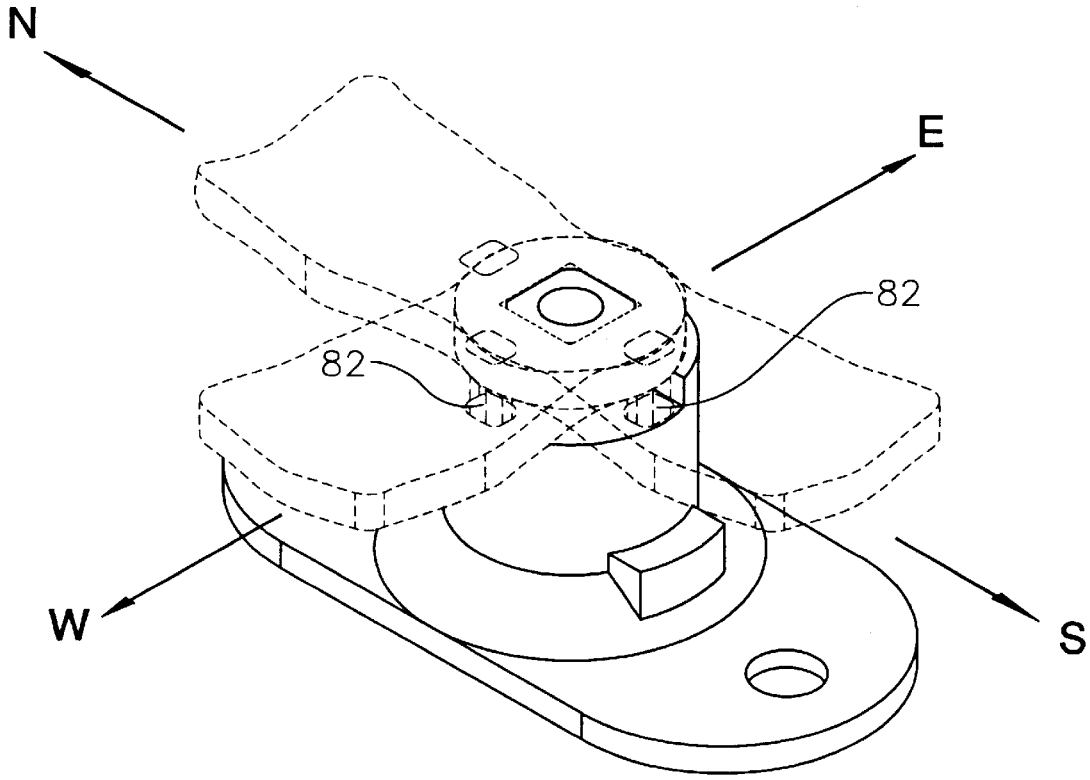
FIG. 5 is a perspective view of the latch housing of FIG. 4 further showing the alternative positions of the engagement arm protrusion of one embodiment of the present invention in broken lines.
Figure 6:
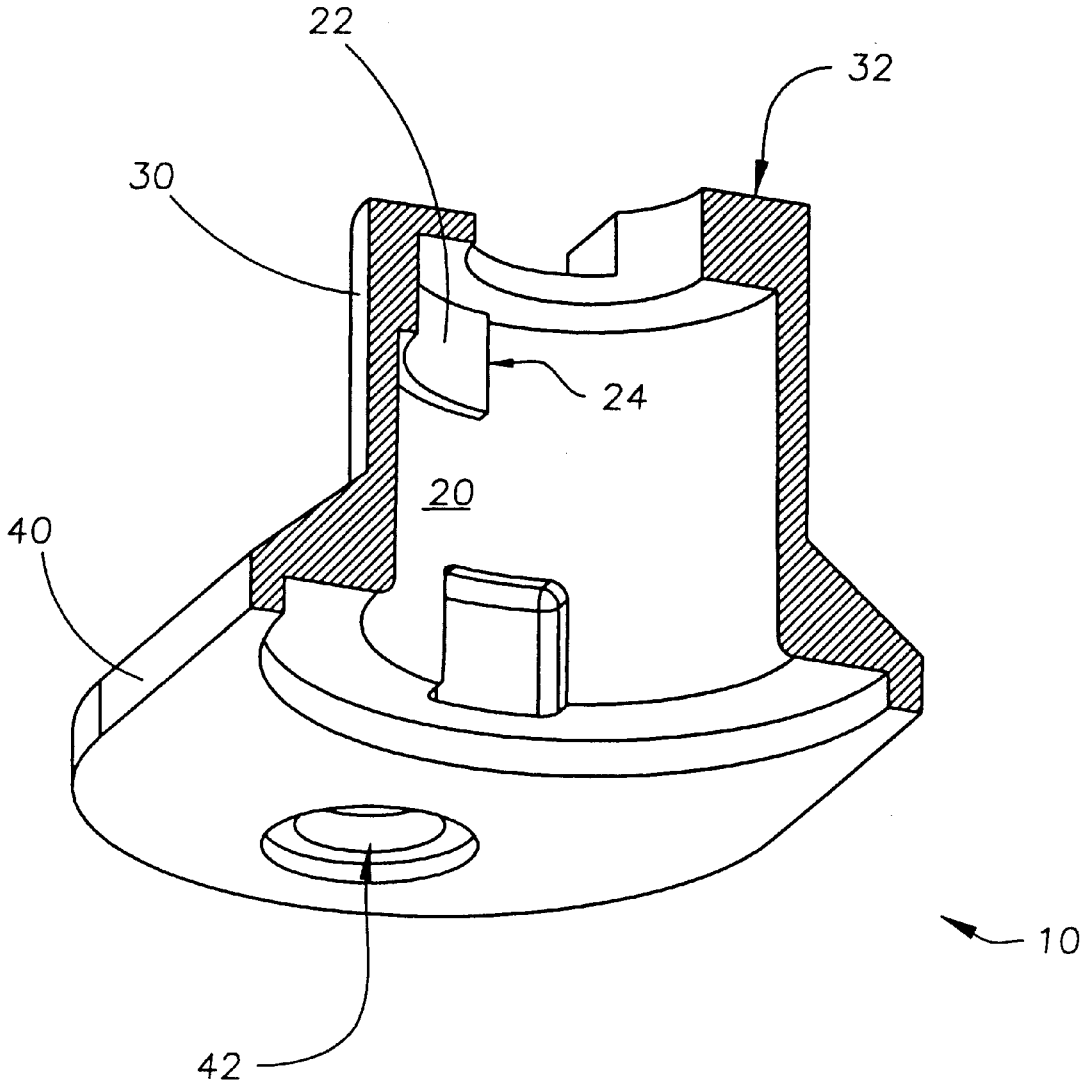
FIG. 6 is a perspective and sectional view of the latch housing of one embodiment of the present invention.

Below are two tables demonstrating several different assemblies afforded by the preferred embodiment illustrated in FIGS. 4 through 7. The first table below shows the range of latch operation resulting from assembling the actuator protrusion 62 and engagement arm protrusion 82 in specific orientations. For ease of discussion, the convention of breaking up the 360° of a circle into the bearings on a compass is used herein to indicate the orientation about the central axis of rotation of the actuator 60 and engagement arm 80. Below the following abbreviations are used to indicate orientations as illustrated in FIGS. 5 and 7: N for north, E for east, S for south, and W for west. The direction of latch engagement and the specific ranges of the actuator and the engagement arm 80 are also shown in the table. The abbreviation CW stands for clockwise, namely in the direction from north to east, etc., and the abbreviation CCW stands for counter-clockwise, namely from north to west, etc., as shown in FIGS. 5 and 7. The second table completes the ranges available by showing the orientations available if the latch housing 10 is itself rotated 180° before being mounted to the closure structure.

Assembly Options Depending on the Orientation of the Engagement Arm to the Actuator Protrusion

| | 1 | 2 | 3 | 4 | 5 | 6 | 7 |
|---|---|---|---|---|---|---|---|
| Actuator Protrusion | N | N | E | E | E | S | S |
| Engagement Arm Protrusion | S | W | S | W | N | W | N |
| Resulting Range of Latch Operation | 180° | 90° | 90° | 90° and 90° | 90° | 90° | 180° |
| Resulting Direction of Latch Engagement | CW | CW | CW | CW and CCW | CCW | CCW | CCW |
| Resulting Range of Actuator Operating Portion | S to N | W to N | S to W | W to N W to S | N to W | W to S | N to S |
| Resulting Range of Engagement Arm | N to S | N to E | E to S | E to S E to N | E to N | S to E | S to N |

Assembly Options when the Housing Is Rotated 180° before Being Mounted

| | 8 | 9 | 10 | 11 | 12 | 13 | 14 |
|---|---|---|---|---|---|---|---|
| Actuator Protrusion | S | S | W | W | W | N | N |
| Engagement Arm Protrusion | N | E | N | E | S | E | S |
| Resulting Range of Latch Operation | 180° | 90° | 90° | 90° and 90° | 90° | 90° | 180° |
| Resulting Direction of Latch Engagement | CW | CW | CW | CW and CCW | CCW | CCW | CCW |
| Resulting Range of Actuator Operating Portion | N to S | E to s | N to E | E to S E to N | S to E | E to N | S to N |
| Resulting Range of Engagement Arm | S to N | S to W | W to N | W to N W to S | W to S | N to W | N to S |

As demonstrated by these tables, the preferred embodiment of the present invention can operate as a quarter-turn latch or a half-turn-latch. As a quarter-turn latch, the latch may be assembled such that the engagement arm 80 may be operated in any one of the four 90° quadrants around the axis of rotation, and it may operate in either the clockwise or counter-clockwise direction. That is, it may be assembled such that the engagement arm 80 will rotate clockwise to engage an external catch, or it may be assembled such that the engagement arm will rotate counter-clockwise to engage the external catch.

As a half-turn latch, the latch may likewise be assembled such that the engagement arm 80 may be operated in either one of the two 180° halves of a full circle around the axis of rotation, and it may operate in either the clockwise or counter-clockwise direction. Further, the latch may be configured alternatively as a bi-directional quarter-turn latch. That is, in two configuration assemblies, shown as assemblies #4 and #11 above, the engagement arm 80 will operate throughout a quarter-turn in either the clockwise or counter-clockwise direction.

While the present invention has been described with regards to particular embodiments, it is recognized that additional variations of the present invention may be devised without departing from the inventive concept.

What is claimed is:

1. A latch assembly, comprising:

a latch housing having first and second housing protrusions, an actuator rotatably mounted in said latch housing and having an actuator protrusion and having a range of rotation, and an engagement arm mounted to said actuator and having an engagement arm protrusion and having a range of rotation, wherein said first housing protrusion may limit the range of rotation of the actuator by interfering with the angular movement of the actuator protrusion and wherein said second housing protrusion may limit the range rotation of the engagement arm by interfering with the angular movement of the arm protrusion; and wherein said second housing protrusion is offset angularly about a mutual central axis of rotation from said first housing protrusion by about 180°.

2. The latch assembly of claim 1, wherein said first housing protrusion is fixably mounted on an inner surface of said housing.

3. The latch assembly of claim 1, wherein said second housing protrusion is fixably mounted on a top surface of said housing.

4. The latch assembly of claim 1, wherein said first housing protrusion limits the range of rotation of the actuator to about 180° or less.

5. The latch assembly of claim 1, wherein said second housing protrusion limits the range of rotation of the engagement arm to about 180° or less.

6. The latch assembly of claim 1, wherein said engagement arm protrusion is an indentation and resulting raised portion formed in sheet metal.

7. The latch assembly of claim 1, wherein said engagement arm protrusion is a rivet.

8. The latch assembly of claim 1, wherein said engagement arm protrusion is a bolt or cross pin.

9. The latch assembly of claim 1, wherein said second housing protrusion is formed as raised part of said housing.

10. The latch assembly of claim 1, wherein said second housing protrusion is a bolt, dowel, or pin.

11. The latch assembly of claim 1, further comprising a means for imparting an angular force on said actuator.

12. A method for providing multiple configurations to choose from for securing the closure of a door, comprising the steps of selecting a latch housing having first and second housing protrusions, selecting an actuator rotatably mounted in said latch housing, said actuator having an actuator protrusion and having a range of rotation, and fixing an engagement arm to said actuator, said engagement arm having an engagement arm protrusion and having a range of rotation, in an orientation such that said first housing protrusion may limit the range of rotation of the actuator by interfering with the angular movement of the actuator protrusion and wherein said second housing protrusion may limit the range rotation of the engagement arm by interfering with the angular movement of the arm protrusion.

13. The method of claim 12, further comprising the step of ensuring that said second housing protrusion is fixably mounted on a top surface of said housing.

14. The method of claim 12, further comprising the step of ensuring that said second housing protrusion is offset angularly about a mutual central axis of rotation from said first housing protrusion by about 180°.

* * * * *